United States Patent [19]

Dara et al.

[11] Patent Number: 4,952,758

[45] Date of Patent: Aug. 28, 1990

[54] APPARATUS FOR HITLESS BY-PASS SWITCHING

[75] Inventors: Prithipal Dara; Greg Abbott, both of Richardson, Tex.

[73] Assignee: Reliance Comm/Tec Corporation, Chicago, Ill.

[21] Appl. No.: 327,685

[22] Filed: Mar. 23, 1989

[51] Int. Cl.[5] ..... H01R 33/96

[52] U.S. Cl. ..... 200/51.09; 439/188; 200/51.11

[58] Field of Search ..... 200/51.11, 51.1, 51.09, 200/51.02; 439/188

[56] References Cited

U.S. PATENT DOCUMENTS

| | | | |
|---|---|---|---|
| 2,797,337 | 6/1957 | Hollins | 200/51.02 |
| 3,369,088 | 2/1968 | Knecht | 200/51.11 |
| 4,037,186 | 7/1977 | Palmer | 200/51.1 X |
| 4,179,178 | 12/1979 | Bachman et al. | 200/51.1 X |
| 4,438,303 | 3/1984 | Astier | 200/51.1 |
| 4,507,697 | 3/1985 | Ozil et al. | 200/51.09 |
| 4,514,030 | 4/1985 | Triner et al. | 439/188 |

FOREIGN PATENT DOCUMENTS

| | | | |
|---|---|---|---|
| 1239385 | 4/1967 | Fed. Rep. of Germany | 439/188 |

*Primary Examiner*—Renee S. Luebke
*Attorney, Agent, or Firm*—Michael M. Rickin

[57] ABSTRACT

An apparatus for providing hitless by-pass switching for signal flow paths on a circuit board. The switches for establishing the by-pass path(s) are mounted adjacent to the connector into which the board is inserted. The circuit board has mounted thereon an apparatus which engages the by-pass switches in a manner so as to open the switches and maintain them open when the board is essentially fully inserted in the connector. Otherwise, the switches are closed. The signal flow paths on the board are conductive when the board is both fully and partially inserted in the connector. When the board is partially inserted in the connector, both the by-pass and circuit board paths are conductive.

4 Claims, 7 Drawing Sheets

20
12
26f to 26j
12g
12a
12e
18
12f
22
16a
Y
X
Z
22a
18a
TO BYPASS SWITCHES
SIGNALS IN/OUT To 14a to 14n
TO BYPASS SWITCHES
18n
16a
16a
16a
BYPASS SWITCH
A
B
C
D
E
F
1
2
3
4
40
COIL VOLTAGE

APPARATUS FOR HITLESS BY-PASS SWITCHING

Background of the Invention

1. Field of the Invention

This invention relates to an apparatus for use with printed circuit (PC) boards and more particularly to such an apparatus which functions to maintain circuit continuity as a PC board is removed from or inserted into its associated card slot.

2. Description of the Prior Art

In some applications, it is required that the removal or insertion of a PC board have minimal detrimental affect on the equipment to which the board is connected. One such application exists in the monitoring and/or routing of the multiple signals carried on a digital transmission line.

A relay network is used in order to monitor and/or route the signals on the transmission line. Such a relay network is embodied in the form of a multiplicity of PC boards (hereinafter "relay boards") to which the transmission lines are connected. Those relay boards in combination with test and control boards are known as a digital test access unit (DTAU). Typically one DTAU will be used to simultaneously monitor and/or route the signals on a multiplicity of transmission lines. Once connected to the transmission lines it is desirable to leave the relay network in place unless it is necessary to remove the same for repair or replacement.

The transmission lines to which the relay network of the DTAU is connected is used to provide service to a multiplicity of subscribers. In order to preserve continuity of service an alternate or by-pass path is provided through a switch for each of the lines to which the DTAU relay boards are connected. Upon removal of any of the relay boards, the alternate path is activated by the closing of the associated switch. If the switch is activated after the relay board is removed, there is a loss of continuity which gives rise to errors in the signals on the lines. Those errors are known as hits. The longer it takes to activate the associated switch after the associated relay board is removed the longer are the hits.

It is desirable that the activation of the by-pass path occur prior to the breaking of the primary path through the relay board. It is also desirable that the activation of the by-pass path take place automatically as the relay board is being removed. Such activation of the by-pass path will ensure that no hits can occur. It is further desirable that the act of removing the relay board should cause the automatic and hitless activation of the by-pass path.

The same concern regarding the occurrence of hits may also arise when a relay board is being inserted. Upon insertion of the relay board the associated switch should be opened as the by-pass path is no longer needed. It is clear that if the by-pass path is opened after the relay board is fully inserted that no hits can occur. If, however, the opening of the by-pass path is left to the person inserting the relay board, instances may occur where the by-pass path is inadvertently opened before the relay board is fully inserted. Therefore, it is also desirable that the same apparatus which automatically activates the by-pass to avoid hits as the relay board is being removed also functions to automatically open the by-pass without hits occurring as the relay board is being inserted. Thus, the act of inserting the relay board should automatically activate the hitless opening of the by-pass path.

Summary of the Invention

An apparatus for providing a by-pass signal flow path for a signal flow path on a circuit board which is conductive when the board is partially inserted in a mounting means. The circuit board signal flow path is also conductive when the board is essentially fully inserted in the mounting means.

The apparatus comprises by-pass switching means external to the mounting means. It also comprises means associated with the circuit board for opening and maintaining open the by-pass switching means only when the circuit board is essentially fully inserted in the mounting means. Otherwise, the by-pass switching means is closed.

Description of the Preferred Embodiments

Figure 1A:
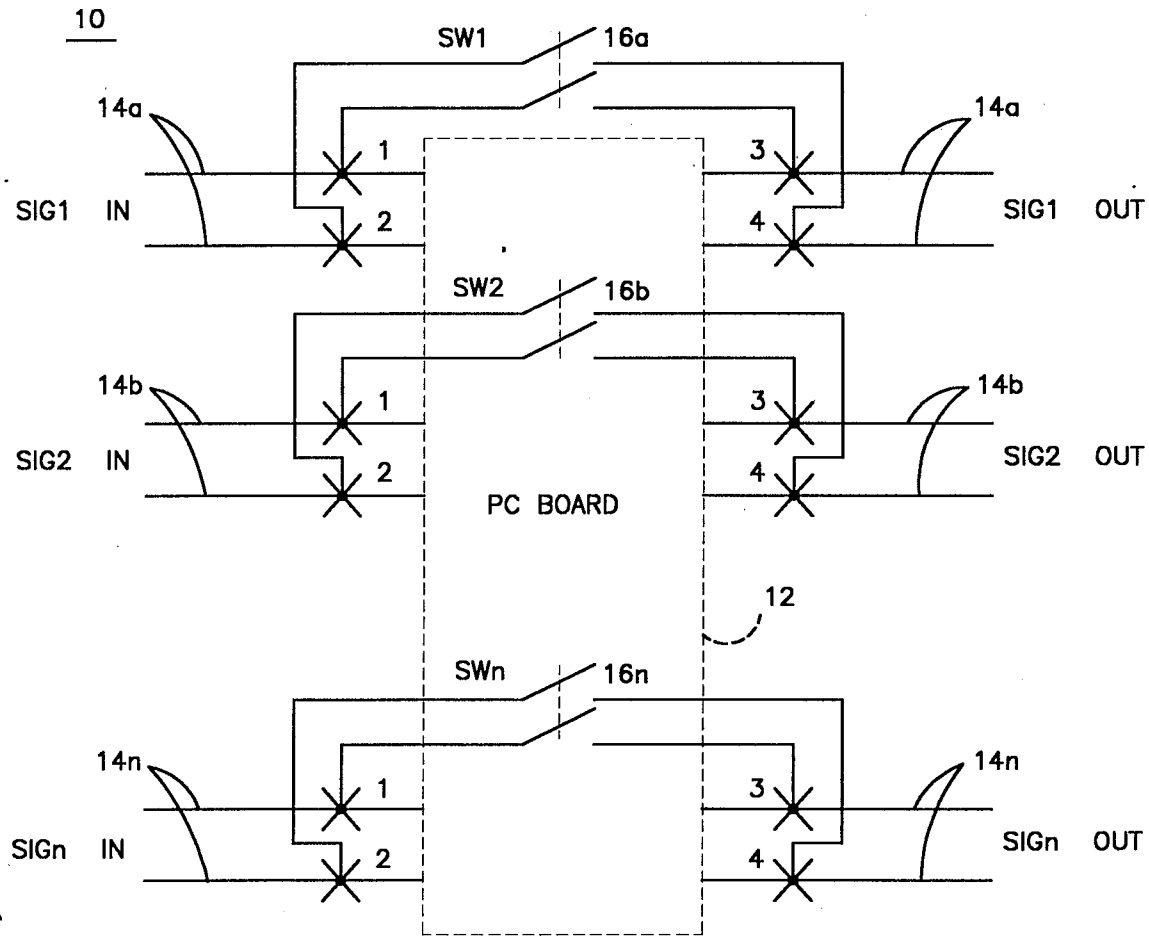
FIG. 1*a* is a block-schematic diagram of a relay board of a digital test access unit relay network.

Referring now to FIG. 1*a*, there is shown a block-schematic diagram of one relay board 12 of a DTAU relay network 10. It should be appreciated that network 10 may include a multiplicity of relay boards which are identical to board 12. Each board 12 is associated with a predetermined number of the lines to which network 10 is connected. Therefore, each board includes the same predetermined number of identical relay networks each associated with a respective one of the lines served by the board. For ease of description only one board 12 will be described hereinafter. No matter how many boards 12 are contained in DTAU 10, they will each be identical to the board 12 being described.

Network 10 uses the apparatus of the present invention to provide automatic and hitless switching of the path for flow of signals when the PC board 12 which contains the relay networks is either removed from or inserted into its associated card edge connector. Each of the input terminals 1–2 and output terminals 3–4 of board 12 are connected to an associated one of board contacts 24*a* to 24*n* (see FIG.2) which in turn are connected to an associated one of digital transmission lines 14*a* to 14*n* when the board is inserted in its card edge connector.

As described above, board 12 contains a predetermined number of relay networks each associated with a respective one of lines 14*a* to 14*n* so that the signals entering terminals 1–2 on each of those lines can either be monitored or routed as desired. In order to maintain continuity of service to the users connected to lines 14*a* to 14*n*, there is associated with each of lines 14*a* to 14*n* an alternative or by-pass path which comes into use when board 12 is removed from its edge connector. That path is provided through the switches 16*a* to 16*n* each associated with a respective one of lines 14*a* to 14*n*.

Figure 1B:
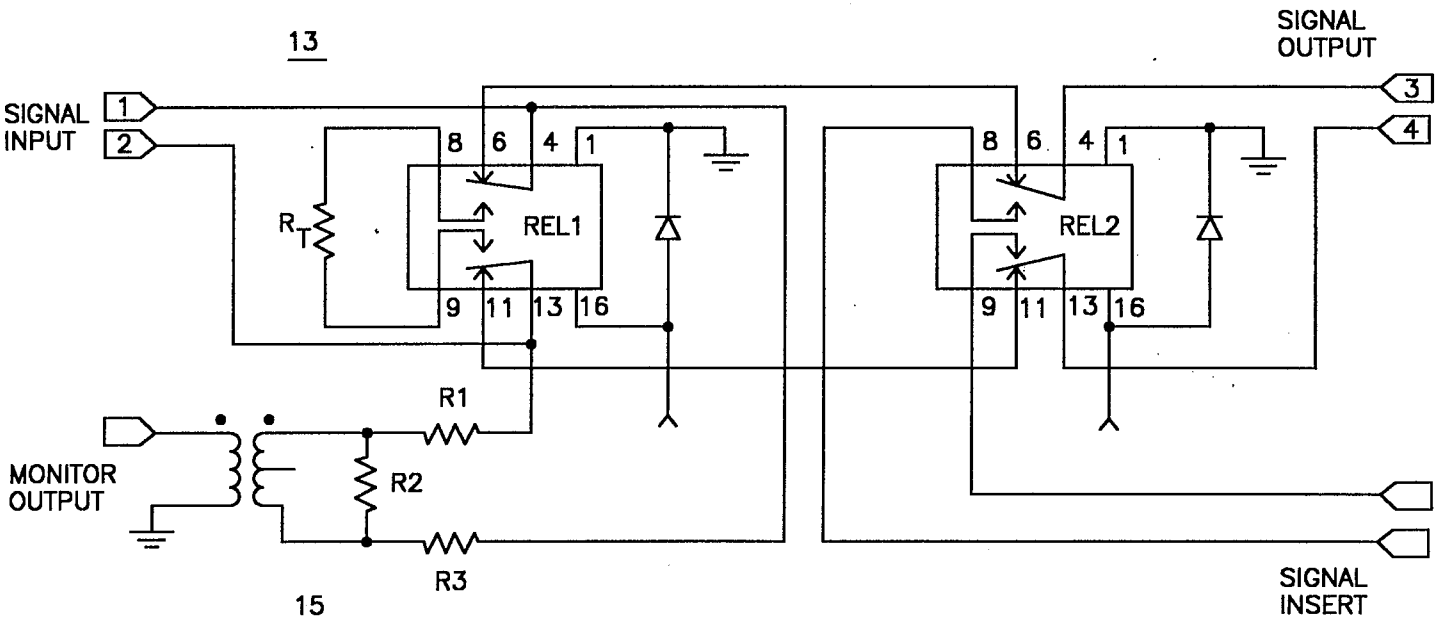
FIG. 1*b* shows one of the relay networks on the relay board of FIG. 1*a*.

Referring now to FIG. 1*b* there is shown one of the relay networks 13 on board 12. Network 13 includes first relay REL1 and second relay REL2. Input terminals 1–2 are connected to pins 4 and 13, respectively of REL1. Input terminals 1–2 are also connected to a circuit 15 which allows the signal on terminals 1–2 to be monitored. As shown circuit 15 includes resistors R1, R2 and R3 whose resistances are selected to present the desired high impedance to the transmission line, and a matching impedance to transformer T1. Output terminals 3–4 are connected to pins 4 and 13, respectively of REL2.

Pins 6 and 11 of REL1 are connected to pins 6 and 11 of REL2. Pins 8 and 9 of REL1 are connected to a terminating resistor $R_T$. Pins 8 and 9 of REL2 are connected to receive a signal which can be inserted on that transmission line to which network 13 is connected in place of the signal on input terminals 1–2 of that line. Pin 1 of REL1 and REL2 are both connected to ground. Pin 16 of REL1 and REL2 are connected to receive a voltage having a negative polarity. In both REL1 and REL2 a damping diode D, polarized as shown, is connected between pins 1 and 16.

In FIG. 1*b*, REL1 and REL2 are both shown in the condition without a negative polarity voltage applied to pin 16. In that condition, pin 4 of both relays is connected to pin 6, and pin 13 of both relays is connected to pin 11. Therefore, when both relays are in that condition, a signal on input terminals 1–2 is connected through REL1 to REL2 which in turn connects it directly to output terminals 3–4. The signal may be monitored at the output of circuit 15.

A negative voltage applied to pin 16 of both relays causes each of them to open the internal connection between pins 4 and 6, and pins 13 and 11 and, instead, connect pin 4 to pin 8 and pin 13 to pin 9. Pins 4 and 13 of REL1 are then connected to terminating resistor $R_T$. The signal present at input terminals 1–2 no longer appears at output terminals 3–4. It should be appreciated that the operation of relay REL1 in the manner described above does not prevent the signal present at terminals 1–2 from appearing at the output of monitoring circuit 15.

Pins 4 and 13 of relay REL2 are connected through relay pins 8 and 9 to signal insert terminals 5–6, respectively. Terminals 5–6 are connected to an associated one of board contacts 24*a* to 24*n* . Therefore, the signal which appears at output terminals 3–4 of network 13 is the signal which has been inserted at terminals 5–6 when relays REL1 and REL2 are operated in the manner described above.

Figure 2:
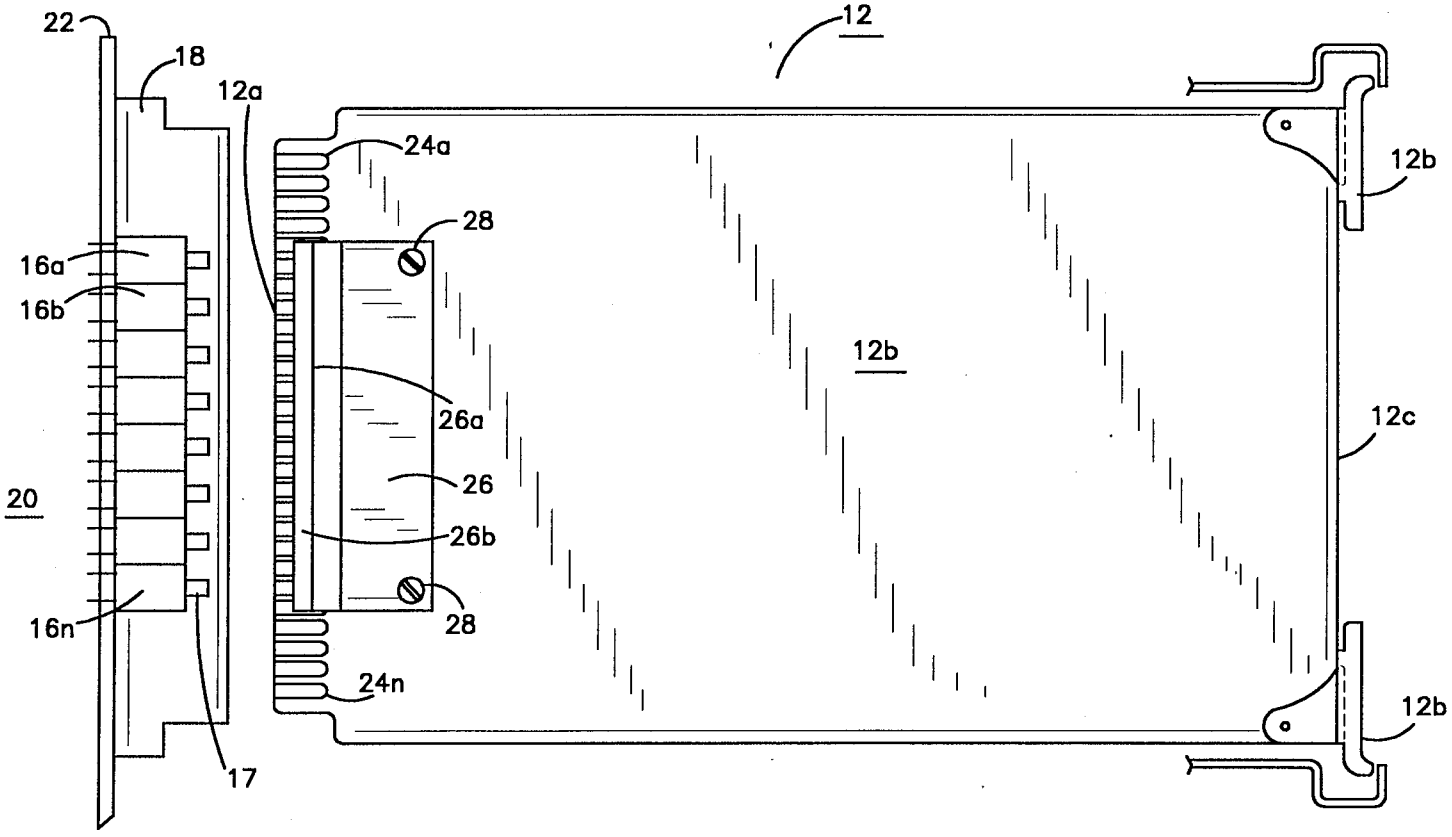
FIG. 2 shows one embodiment for the apparatus of the present invention.

Referring now to FIG. 2 there is shown one embodiment for an apparatus 20 used in combination with network 10 to provide automatic and hitless switching when relay networks PC board 12 is removed from or inserted into its associated edge connector 18. Edge connector 18 is mounted on backplane 22. As is well known in the art, connector 18 includes a multiplicity of contacts (not shown). PC board 12 includes on the edge 12*a* which is inserted into connector 18 a multiplicity of contacts 24*a* to 24*n* each associated with a respective one of the contacts in connector 18. As described above, the terminals 1–6 of relay network 13 are connected to associated ones of contacts 24*a* to 24*n*.

Mounted on backplane 22 adjacent to and on one side of connector 18 are the multiplicity of switches 16*a* to 16*n* which, as has been described in connection with FIG. 1*a*, provide upon closure the by-pass path for each of lines 12*a* to 12*n*. Each of switches 16*a* to 16*n* are of the type which include an actuator 17 which when depressed opens the switch. When board 12 is fully inserted in connector 18, it is desired that each of switches 16*a* to 16*n* are held in the open position as it is board 12 which provides the path for each of lines 14*a* to 14*n*.

In order to hold each of switches 16*a* to 16*n* in the open position when card 12 is fully inserted in connector 18, board 12 includes on the face 12*b* a switch control bracket 26. Bracket 26 is mounted on face 12*b* for example by screws 28. As is shown most clearly in FIGS. 3*a* to 3*c* to be described hereinafter, bracket 26 includes an edge 26*a* on which an elastic pad 26*b* is mounted. Bracket 26 is designed such that pad 26*b* engages the actuator 17 of each of switches 16*a* to 16*n* in a manner such the actuator is fully depressed, i.e. the switches are held in the open position, when card 12 is fully inserted in connector 18. Also as is shown most clearly in FIGS. 3*a* to 3*c*, bracket 26 is raised above card face 12*b* so that edge 26*a* and pad 26*b* are aligned with actuator 17 so as to come into contact therewith as the board 12 is inserted a sufficient distance into connector 18.

Figures 3A, 3B, 3C:
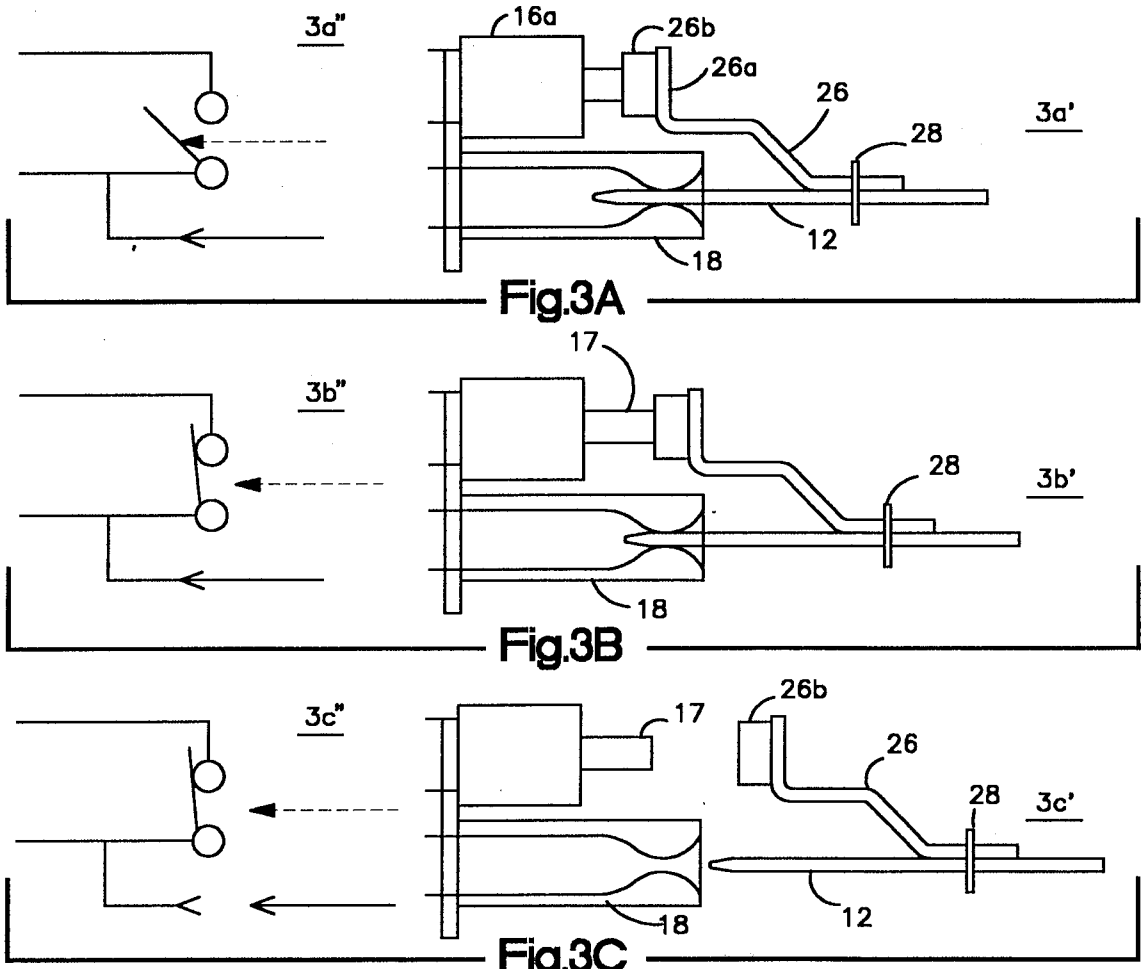
FIGS. 3*a* to 3*c* show in side-by-side circuit schematic form and simplified mehanical diagram form the automatic and hitless by-pass switching which is provided by the apparatus of FIG. 2.

Referring now to FIGS. 3*a* to 3*c* there is shown in side-by-side circuit schematic form and simplified mechanical diagram form the automatic and hitless by-pass switching which is provided by the apparatus 20 as board 12 is removed from connector 18. For ease of illustration, only one switch 16*a* is shown in FIGS. 3*a* to 3*c*. For ease of description, it is assumed hereinafter that switch 16*a* is associated with digital transmission line 14*a*. It should, however, be appreciated that switches 16*b* to 16*n* function in exactly the same manner as switch 16*a* when board 12 is extracted from connector 18.

FIG. 3*a* shows the board fully inserted in connector 18. As shown in the schematic diagram, switch 16*a* is open because, as is shown in the mechanical diagram, actuator 17 is fully depressed by pad 26*b*. Assume that it is desired to remove, for example for repair or replacement, board 12. Referring once again to FIG. 2, the retaining levers 12*b* mounted on board edge 12*c* would then be rotated in a manner well known in the art so that the board could be removed from connector 18. In fact the rotating of levers 12*b* provides the initial force to start the disengagement of edge 12*a* from connector 18.

As the board is removed from connector 18, a condition is reached at which board edge 12*a* is still electrically in contact with connector 18, yet actuator 17 is no longer depressed sufficiently to keep switch 16*a* open. Switch 16*a* is closed. That condition is shown in FIG. 3*b*. As the board is still in contact with connector 18, the closing of switch 16*a* has provided a parallel path for the signals present on transmission line 14*a*. In other words, the signals on line 14*a* flow both through the path provided by the board 12 and the by-pass path provided by the closing of switch 16*a*.

As the board is further removed from connector 18, board edge 12*a* disengages from the connector. Switch 16*a* remains closed. That condition is shown in FIG. 3*c*. As shown therein, the by-pass path through switch 16*a* is now the only path for signals on line 14*a*.

The manner in which the mechanical apparatus 20 of the present invention provides both automatic and hitless by-pass switching as board 12 is extracted from connector 18 should now be evident. That hitless switching results from the closing of the by-pass path by the mechanical action of removing the board prior to the disconnection of the path provided by board 12. Thus, it is the combination of switches 16*a* to 16*n* and switch control bracket 26 which provide the automatic and hitless by-pass switching as the board is removed.

The apparatus 20 of the present invention also automatically ensures that the insertion of board 12 into connector 18 will also be hitless. As can be seen from FIG. 3*c*, without the board inserted in the connector the switch provides the by-pass path. As the board is inserted its edge 12*a* comes into contact with connector 18. Bracket edge pad 26*b* also comes into contact with actuator 17. As can be seen from FIG. 3*b*, the path through the board is provided while the by-pass path is still active. Thereafter a further insertion of the board into connector 18, as shown in FIG. 3*a*, breaks the by-pass path by opening switch 16*a* while maintaining the path through the board.

Figures 4A, 4B:
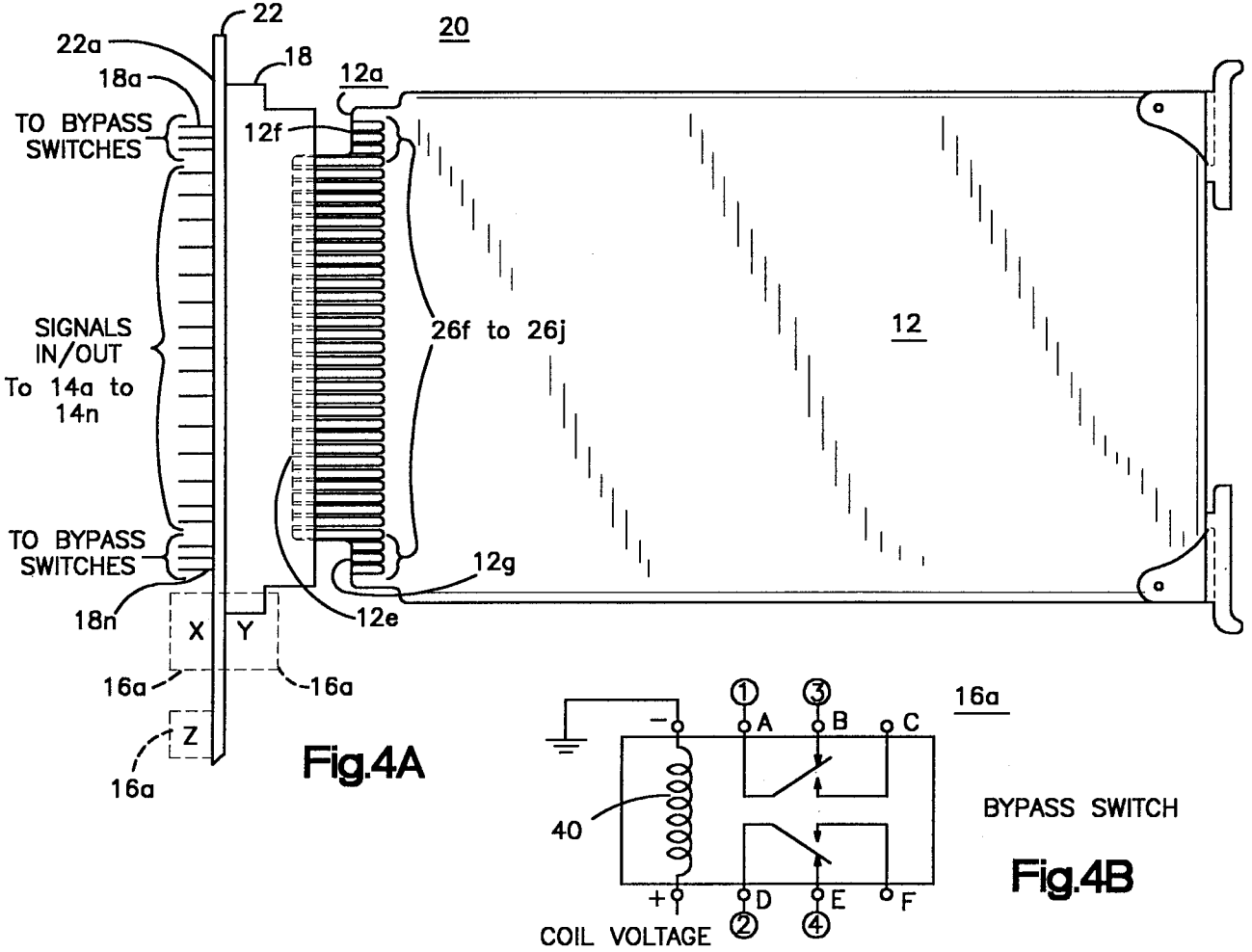
FIG. 4 shows a first alternative embodiment for the apparatus of the present invention.

Referring now to FIG. 4, there is shown a first alternative embodiment for apparatus 20. In this embodiment the switch 16*a* may be mounted on either side of the backplane 22. Several possible locations for mounting switch 16*a* are shown by the dotted lines designated as X, Y and Z in FIG. 4.

Switch 16*a* may be embodied either as an electromechanical switch such as a relay, or an electronic solid state switch such as a switching transistor. Connector 18 includes a multiplicity of pins 18*a* to 18*n* which project outwardly from side 22*a* of the backplane 22. Some of those pins are associated with by-pass switch 16*a* and are so labeled in FIG. 4. Those pins connect the switch through connector 18 to circuitry (not shown) on board 12 which holds the switch open when the board is fully inserted in the connector. The remainder of those pins 18*a* to 18*n* are connected to transmission lines 14*a* to 14*n*, i.e., those connector pins are associated with input and output terminals 1–2 and 3–4 for lines 14*a* to 14*n*, and are so labeled in FIG. 4.

In order that the by-pass path through switch 16*a* be activated before the path on board 12 is opened as the board is removed from the connector, edge 12*a* includes the outwardly projecting portion 12*e* shown partially in phantom in FIG. 4. The contacts of connector 18 relating to switch 16*a* are connected to one or more of the contacts 26*f* to 26*j* on those parts 12*f* and 12*g* of edge 12*a* when board 12 is fully inserted in the connector.

In FIG. 4, board 12 is shown partially inserted in connector 18 such that projection 12*e* is still in electrical contact with the connector. Parts 12*f* and 12*g* of edge 12*a* are not in contact with connector 18. The circuitry on board 12 which holds switch 16*a* open is not connected to the switch. Therefore, switch 16*a* is closed and the by-pass path is operational.

As board 12 is further removed from connector 18, projection 12*e* breaks electrical contact with the connector. The path through the board is opened leaving only the by-pass path.

When board 12 is reinserted into connector 18, it is projection 12*e* which comes into electrical contact with the connector before parts 12*f* and 12*g*, i.e., the contacts 26*f* to 26*j*, do. The path through board 12 is then reestablished prior to the breaking of the by-pass path by the complete insertion of board 12 into the connector.

There is shown in symbolic form in FIG. 4 an embodiment for switch 16*a*. In that embodiment, the switch is shown in the closed or by-pass condition. When board 12 is fully inserted in connector 18, a voltage provided by contacts 26*f* to 26*j* excites coil 40. When excited, coil 40 causes switch 16*a* to operate to connect contact A of the switch to contact C, and contact D to contact F. The continuing presence of the voltage maintains those connections. As contact A is connected to input pin 1 and contact D is connected to input pin 2 and as contacts C and F are unconnected, the connection of A to C and D to F opens the by-pass path.

Contact B of the switch is connected to output pin 3 and contact E is connected to output pin 4. When the board 12 is removed from connector 18 sufficiently so that parts 12*f* and 12*g* are no longer in contact with the connector, a voltage is no longer provided to coil 40. The loss of that voltage causes contact A to be connected to contact B and contact D to be connected to contact E. This closes switch 16*a* to establish the by-pass path. While the symbolic form in which switch 16*a* is shown in FIG. 4 appears to be electro-mechanical, i.e., a relay, those of ordinary skill in the art will be able to make the necessary changes so that switch 16*a* is a solid state device, e.g. a switching transistor.

Figure 5A:
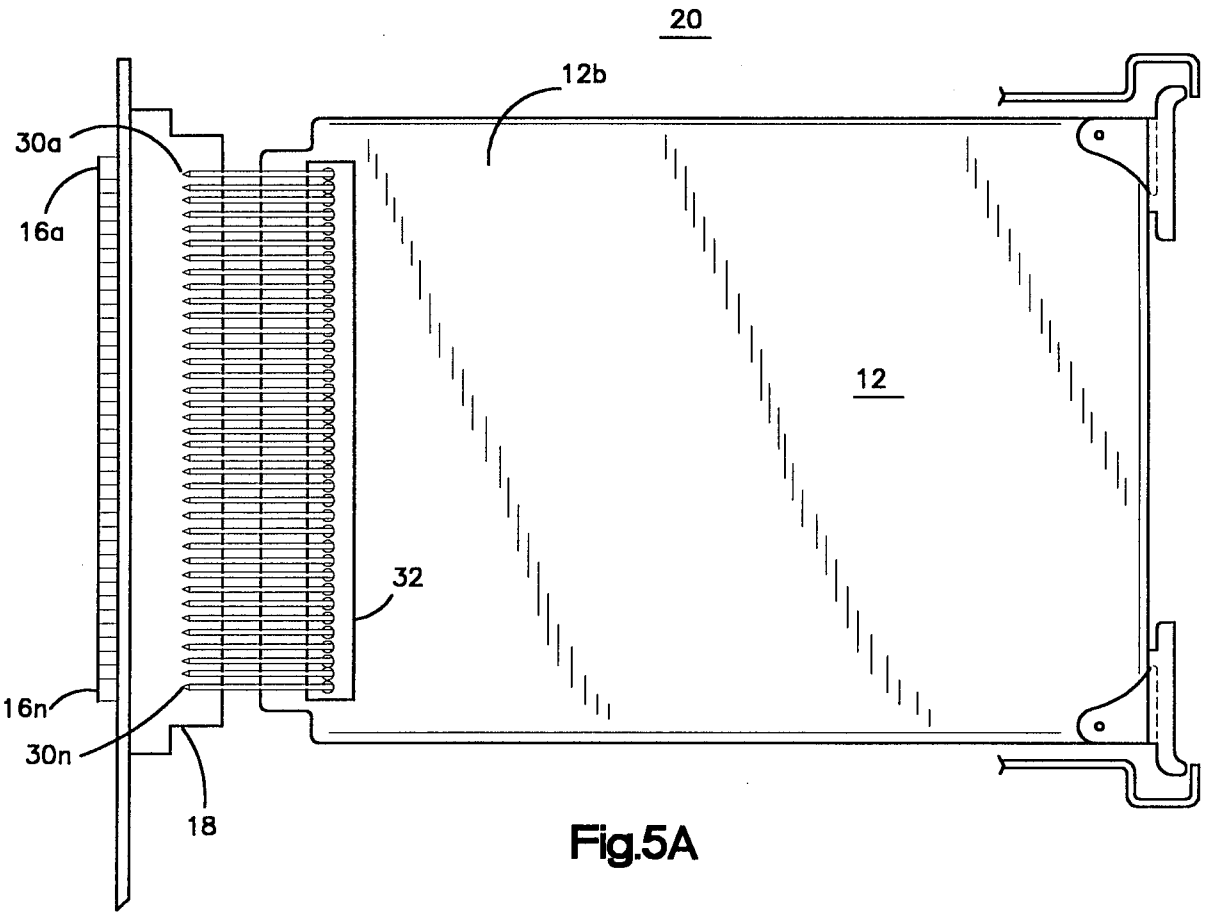
FIGS. 5*a* to 5*c* show various views for a second alternative embodiment for the apparatus of the present invention.
Figure 5B:
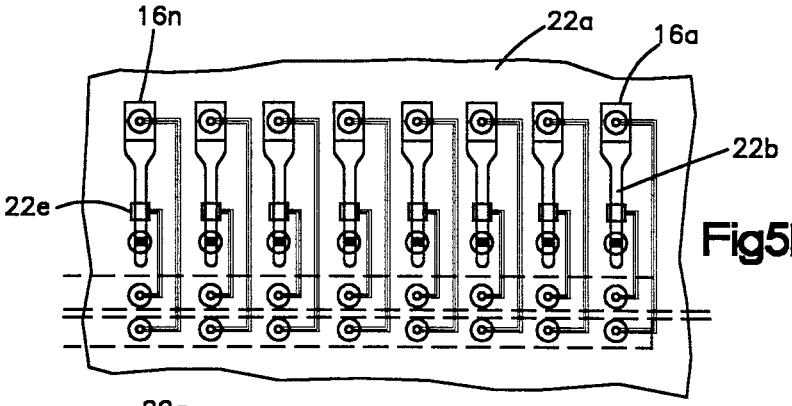
Figure 5C:
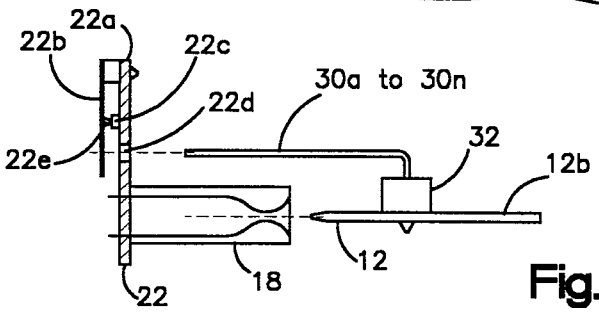

Referring now to FIGS. 5*a*, 5*b* and 5*c*, there are shown various views of a second alternative embodiment for apparatus 20. In this embodiment there is included on side 22*a* of backplane 22 a conductive trace 22*c* and a spring arm 22*b* with a contact element 22*e* for each of switches 16*a* to 16*n*. The spring arm and contact element for each of the switches are wired to connector 18.

Figure 6A:
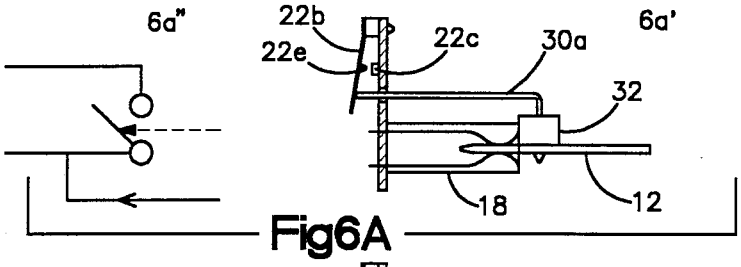
FIGS. 6*a* to 6*c* show in side-by-side circuit schematic form and simplified mechanical diagram form the automatic and hitless by-pass switching which is provided by the alternative embodiment of FIGS. 5*a* to 5*c*.

There is mounted on face 12*b* of board 12 an upwardly projecting block 32 which contains a multiplicity of L shaped outwardly projecting fingers 30*a* to 30*n* each associated with a respective one of switches 16*a* to 16*n*. Backplane 22 includes a multiplicity of openings 22*d* through which an associated one of fingers 30*a* to 30*n* project when board 12 is inserted in connector 18. When board 12 is fully inserted in connector 18, the fingers 30*a* to 30*n* apply force against the associated one of spring arms 22*b* so as to keep contact element 22*e* from coming into electrical contact with trace 22*c*. In other words, when board 12 is fully inserted in connector 18, switches 16*a* to 16*n* are open. This is shown in side-by-side circuit schematic form and simplified mechanical diagram form in FIG. 6*a*.

Figure 6B:
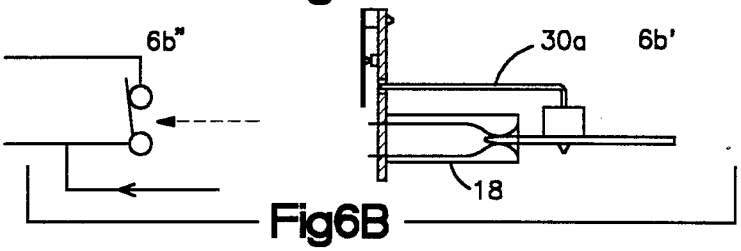
Figure 6C:
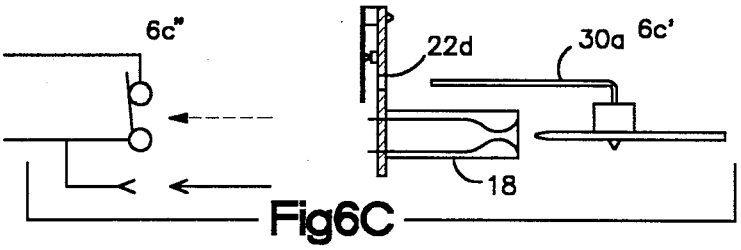

As board 12 is extracted from connector 18, the length of fingers 30*a* to 30*n* are such as to allow contact element 22*e* to come into electrical connection with trace 22*c* prior to removal of the board from the connector. This is shown in FIG. 6*b*. In this manner, the by-pass path is activated prior to the opening of the path through board 12 as the board is removed from the connector. FIG. 6*c* shows the board fully removed from the connector.

It should be clear that as board 12 is inserted into connector 18, the length of fingers 30*a* to 30*n* are such that the board comes into contact with connector 18 to activate the path through the board prior to the fingers applying sufficient force to spring arms 22*b* to open the by-pass path.

While not shown in FIGS. 5*a* to 5*c*, those skilled in the art will recognize that this embodiment may include a cover for environmentally protecting the switches. Alternatively, all of the switches may be contained in a housing which includes all of the components necessary to embody them as shown in the figures. The housing would then be mounted on side 22*a* and also include the necessary means to interconnect each switch with connector 18. The housing would also include the means to receive the associated one of the fingers 30*a* to 30*n* for each of switches 16*a* to 16*n*.

It should be appreciated that while several alternative embodiments have been shown for the apparatus 20 of the present invention that all of the embodiments provide for automatic and hitless switching of the path for flow of signals when the board 12 is either removed from or inserted into its associated connector. It should further be appreciated that such automatic and hitless switching results from the movement of the board upon removal from or insertion into its associated slot. This means that the person removing or inserting the board need not perform any other tasks in order to ensure that hitless switching automatically occurs.

It is to be understood that the description of the preferred embodiments are intended to be only illustrative, rather than exhaustive, of the present invention. Those of ordinary skill will be able to make certain additions, deletions, and/or modifications to the embodiments of the disclosed subject matter without departing from the spirit of the invention or its scope, as defined by the appended claims.

What is claimed is:

1. An apparatus for providing a by-pass signal flow path for a signal flow path on a circuit board which circuit board signal flow path is conductive when said circuit board is partially inserted in a mounting means and also when said board is essentially fully inserted in said mounting means, said apparatus comprising:

(a) by-pass switching means external to said mounting means, said by-pass switching means having electrically actuable means for opening said switching means when fully engaged, said electrically actuable means fully engaged in response to a signal; and (b) means associated with said circuit board for opening and maintaining open said by-pass switching means only when said circuit board is essentially fully inserted in said mounting means, said by-pass switching means being otherwise closed, said means associated with said circuit board fully engaging said electrically actuable means by providing said signal only when said circuit board is essentially fully inserted in said mounting means.

2. An apparatus for providing a by-pass signal flow path for a signal flow path on a circuit board which circuit board signal flow path is conductive when said circuit board is partially inserted in one side of a mounting means and also when said board is essentially fully inserted in said mounting means one side, said apparatus comprising:

(a) by-pass switching means mounted on the other side of said mounting means, said by-pass switching means having actuable means for opening said switching means only when fully engaged; and (b) means associated with said circuit board for opening and maintaining open said by-pass switching means by fully engaging said actuable means only when said circuit board is essentially fully inserted in said mounting means one side, said by-pass switching means being otherwise closed, said mounting means including means for allowing said means associated with said circuit board to fully engage said actuable means only when said board is essentially fully inserted in said mounting means one side.

3. An apparatus for providing a by-pass signal flow path for a signal flow path on a circuit board which circuit board signal flow path is conductive when said circuit board is partially inserted in a mounting means and also when said board is essentially fully inserted in said mounting means, said apparatus comprising:

(a) electrically actuable by-pass switching means associated with said mounting means; and (b) means associated with said circuit board for opening and maintaining open said by-pass switching means only when said circuit board is essentially fully inserted in said mounting means, said by-pass switching means being otherwise closed.

4. The apparatus of claim 3 wherein said electrically actuable by-pass switching means opens in response to a signal and said means associated with said circuit board provides said signal only when said circuit board is essentially fully inserted in said mounting means.

* * * * *